US010919731B2

(12) United States Patent
Talonen

(10) Patent No.: US 10,919,731 B2
(45) Date of Patent: Feb. 16, 2021

(54) ELEVATOR SYSTEM AND COUNTERWEIGHT SCREEN

(71) Applicant: Kone Corporation, Helsinki (FI)

(72) Inventor: Tapani Talonen, Helsinki (FI)

(73) Assignee: Kone Corporation, Helsinki (FI)

( * ) Notice: Subject to any disclaimer, the term of this patent is extended or adjusted under 35 U.S.C. 154(b) by 363 days.

(21) Appl. No.: 15/970,155

(22) Filed: May 3, 2018

(65) Prior Publication Data

US 2018/0319629 A1 Nov. 8, 2018

(30) Foreign Application Priority Data

May 5, 2017 (EP) ..... 17169717

(51) Int. Cl.
*B66B 5/00* (2006.01)
*B66B 11/00* (2006.01)

(52) U.S. Cl.
CPC ..... *B66B 5/0056* (2013.01); *B66B 11/0005* (2013.01)

(58) Field of Classification Search
CPC ..... B66B 5/0043; B66B 5/005; B66B 5/0056; B66B 7/027; B66B 11/0005
See application file for complete search history.

(56) References Cited

U.S. PATENT DOCUMENTS

| | | | | |
|---|---|---|---|---|
| 763,976 | A * | 7/1904 | Gurney | B66B 17/34 187/357 |
| 9,505,588 | B2 * | 11/2016 | Guillot | B66B 7/027 |
| 9,908,746 | B2 * | 3/2018 | Yu | B66B 7/00 |
| 2008/0083587 | A1 * | 4/2008 | Bloch | B66B 5/005 187/343 |
| 2010/0200339 | A1 * | 8/2010 | Henseler | B66B 5/005 187/401 |
| 2012/0305334 | A1 * | 12/2012 | Kocher | B66B 5/005 187/247 |

FOREIGN PATENT DOCUMENTS

| | | | |
|---|---|---|---|
| CN | 204038808 | U | 12/2014 |
| EP | 3118150 | A1 | 1/2017 |
| JP | 2004196533 | A | 7/2004 |

OTHER PUBLICATIONS

Extended European Search Report #17169717.0 dated Nov. 27, 2017.

* cited by examiner

*Primary Examiner* — Minh Truong
(74) *Attorney, Agent, or Firm* — Harness, Dickey and Pierce, P.L.C.

(57) ABSTRACT

An elevator system comprising a shaft having a pit, a car guided by a pair of first guide rails to be vertically movable in the shaft, a counterweight connected to the car by a suspension rope, the counterweight being guided by a pair of second guide rails to be vertically movable in the shaft, and a counterweight screen in a space between the counterweight and the car, the counterweight screen being attached to the second guide rails at the pit. The counterweight screen is a sandwich-structured composite panel.

19 Claims, 3 Drawing Sheets

ELEVATOR SYSTEM AND COUNTERWEIGHT SCREEN

This application claims priority to European Patent Application No. 171697170 filed on May 5, 2017, the entire contents of which are incorporated herein by reference.

FIELD OF THE INVENTION

The present invention relates to an elevator system. The present invention also relates to a counterweight screen.

BACKGROUND OF THE INVENTION

In prior art is known an elevator system comprising a shaft having a pit. A car is guided by a pair of first guide rails to be vertically movable in the shaft. A counterweight is connected to the car by a suspension rope. The counterweight is guided by a pair of second guide rails to be vertically movable in the shaft. A counterweight screen is arranged in a space between the counterweight and the car. The counterweight screen is attached to the second guide rails at the pit. The counterweight screen is a protective safety cover which is supposed to guard the path of the counterweight and to prevent any object from entering into the path of the counterweight. By definition, a pit is the part of the shaft situated below the lowest landing served by the car. New elevator standards EN 81-20 and EN 81-50 set requirements for stiffness of the counterweight screen. With a 300 N static force exerted to the counterweight screen it is not allowed to bend so much that it can touch the counterweight. The standard EN 81-21 sets reduced requirements for clearances. With higher counterweight screen stiffness requirements together with reduced clearances set problem for the technical solution. Counterweight screens have been typically made from sheet metal material.

Stiffness of the counterweight screen has been increased with bends or with pressed or roll formed grooves. A problem is that increasing stiffness in counterweight screen material increases also weight and costs of the counterweight screen. Additional weight impacts problems in installation and maintenance. Also separate stiffeners, such as stiffening profiles or flat stiffeners, have been used which have been glued or riveted to the screen plate. If stiffness is increased by separate stiffeners (profiles of flat sheet metals typically fixed by glue or rivets), both weight and cost will increase too much. Also, this solution is taking too much space for reduced clearance between car and counterweight. When stiffness is increased by stiffening forms (pressed or roll formed) total thickness impacts problems with reduced clearance. Also with lower volume, pressing tooling cost is increasing too high.

OBJECTIVE OF THE INVENTION

The objective of the invention is to alleviate the disadvantages mentioned above.

In particular, it is an objective of the present invention to provide a light-weight counterweight screen which can have a small thickness with good stiffness.

SUMMARY OF THE INVENTION

According to a first aspect, the present invention provides an elevator system comprising a shaft having a pit, a car guided by a pair of first guide rails to be vertically movable in the shaft, a counterweight connected to the car by a suspension rope, the counterweight being guided by a pair of second guide rails to be vertically movable in the shaft, and a counterweight screen arranged in a space between the counterweight and the car, the counterweight screen being attacked to the second guide rails at the pit. According to the invention the counterweight screen is a sandwich-structured composite panel.

The technical effect of the invention is that that it provides a light-weight counterweight screen which is feasible for installation and maintenance. A wide counterweight with required large counterweight screen size can have good stiffness and weight/total thickness ratio enabling reduced clearance between car and counterweight, especially with wide counterweights, where it is difficult to reduce bending of the counterweight screen. The invention provides a cost efficient way to implement a thin counterweight screen with high stiffness.

In an embodiment of the elevator system, the sandwich-structured composite panel of the counterweight screen comprises a first face skin, a second face skin, and a core arranged between the first face skin and the second face skin, the first and second face skins being attached to the core.

In an embodiment of the elevator system, the first face skin is sheet metal and/or the second face skin is sheet metal.

In an embodiment of the elevator system, the first face skin is steel sheet metal and/or the second face skin is steel sheet metal.

In an embodiment of the elevator system, the first face skin is aluminum sheet metal and/or the second face skin is aluminum sheet metal.

In an embodiment of the elevator system, the first face skin is a polymer sheet and/or the second face skin is a polymer sheet.

In an embodiment of the elevator system, the first face skin is a non-metallic fibre reinforced polymer matrix sheet and/or the second face skin is a non-metallic fibre reinforced polymer matrix sheet.

In an embodiment of the elevator system, the core is a honeycomb structure.

In an embodiment of the elevator system, the honeycomb structure of the core is made of metal.

In an embodiment of the elevator system, the honeycomb structure of the core is made of polymer.

In an embodiment of the elevator system, the core is a micro lattice structure. Micro lattice structure is composed of a network of interconnecting struts.

In an embodiment of the elevator system, the micro lattice structure of the core is made of metal.

In an embodiment of the elevator system, the micro lattice structure of the core is made of polymer.

In an embodiment of the elevator system, the core is a solid or foam sheet of polymer or polyurethane.

In an embodiment of the elevator system, the core is a metallic foam structure.

In an embodiment of the elevator system, the metallic foam structure of the core is made of aluminum.

In an embodiment of the elevator system, the counterweight screen is designed to withstand a force of 300 N over the area of 5 $cm^2$ without deflecting into the path of the counterweight, said force being a force which a person may be expected to exert to the counterweight screen.

In an embodiment of the elevator system, the counterweight screen has a thickness less than 6 mm.

According to a second aspect, the present invention provides a counterweight screen. According to the invention the counterweight screen is a sandwich-structured composite panel.

It is to be understood that the aspects and embodiments of the invention described above may be used in any combination with each other. Several of the aspects and embodiments may be combined together to form a further embodiment of the invention.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Figure 1:
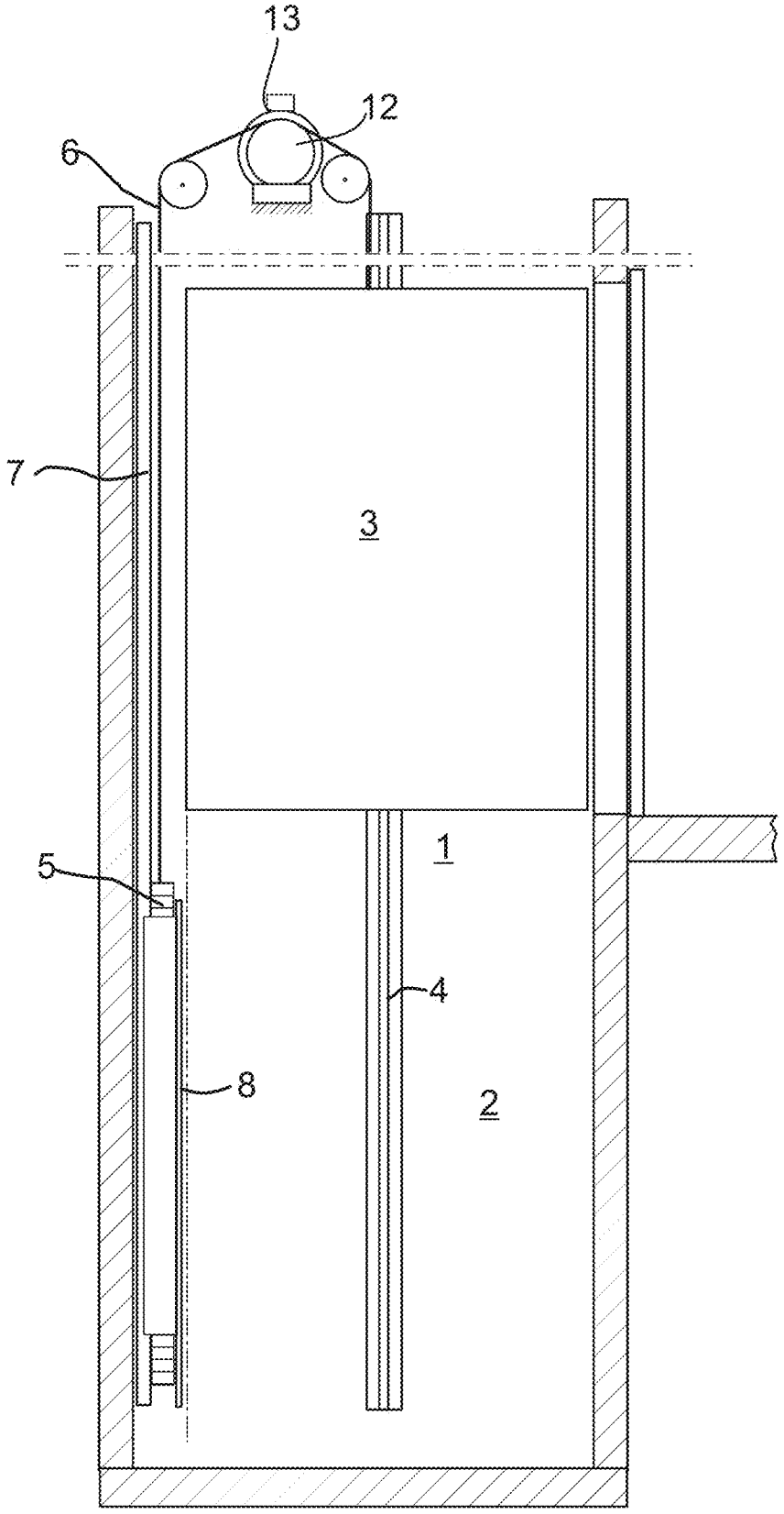
FIG. 1 schematically shows an elevator system according to one embodiment of the invention.
Figure 2:
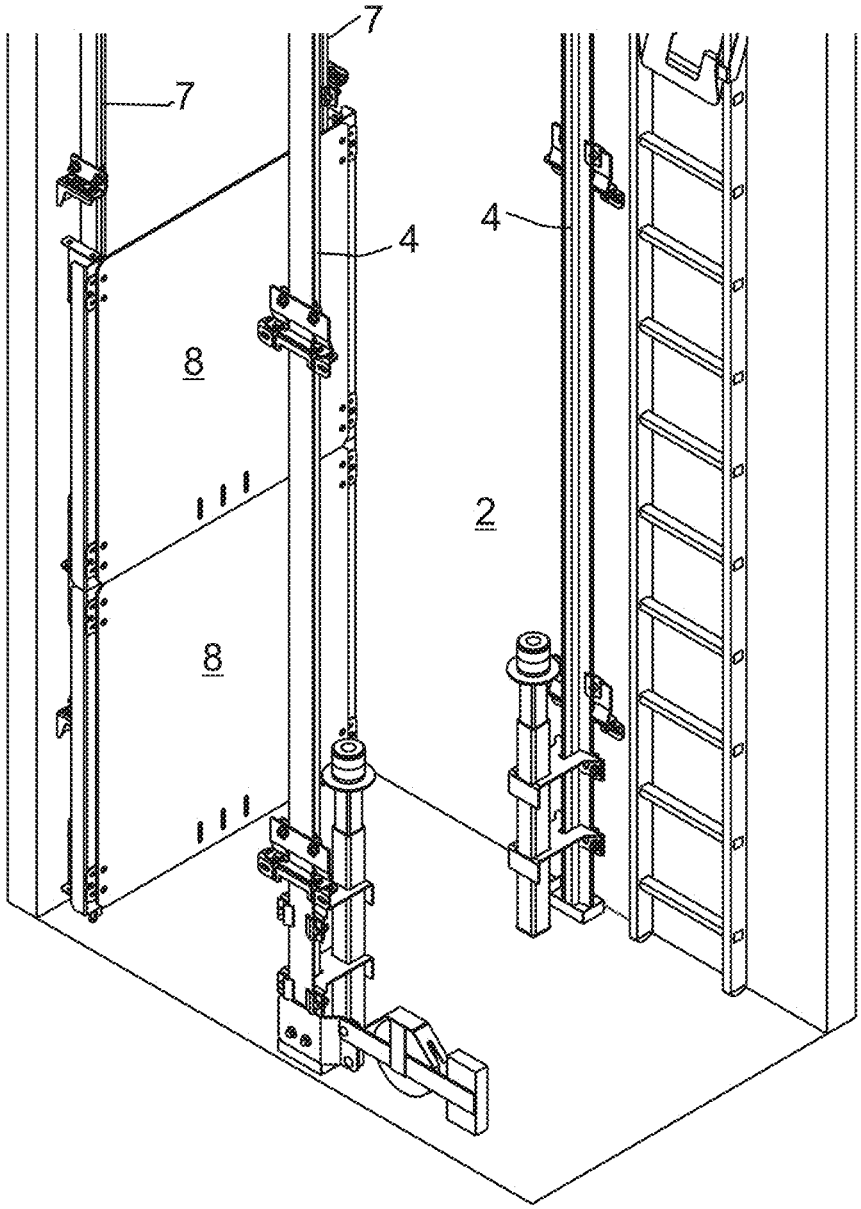
FIG. 2 is an axonometric view of the pit of the shaft of the elevator system according to one embodiment of the invention.

Referring to FIGS. 1 and 2, the elevator system comprises a shaft 1. Part of the shaft 1 situated below the lowest landing served by a car 2 is a pit 2. The car 3 is guided by a pair of first guide rails 4 to be vertically movable in the shaft. A counterweight 5 is connected to the car 3 by a suspension rope 6. The suspension rope 6 runs over a traction wheel 12 driven by a hoisting machine 13. The counterweight 5 is guided by a pair of second guide rails 7 to be vertically movable in the shaft 1. A counterweight screen 8 is arranged at the pit 2 in a space between the counterweight 5 and the car 3. The counterweight screen 8 is attached to the second guide rails 7. The counterweight screen 8 is a sandwich-structured composite panel. As can be seen in FIG. 2, some equipment which may require maintenance is located in the pit 2. Therefore, a maintenance person may be required to enter the pit 2. The counterweight screen 8 is designed to withstand a force of 300 N over the area of 5 $cm^2$ without deflecting into the path of the counterweight 5. The force of 300 N is a force which a person may be expected to exert to the counterweight screen in accordance with standard EN-81-20. Preferably the counterweight screen 8 has a thickness less than 6 mm.

Figure 3:
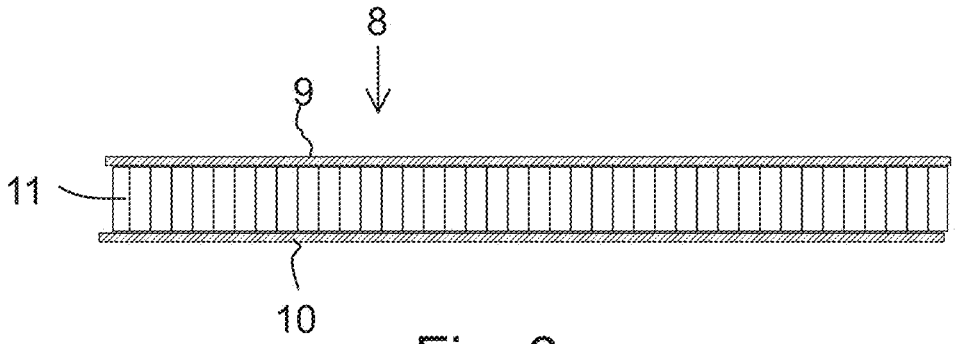
FIG. 3 is a cross-section of the counterweight screen according to first embodiment of the invention.
Figure 4:
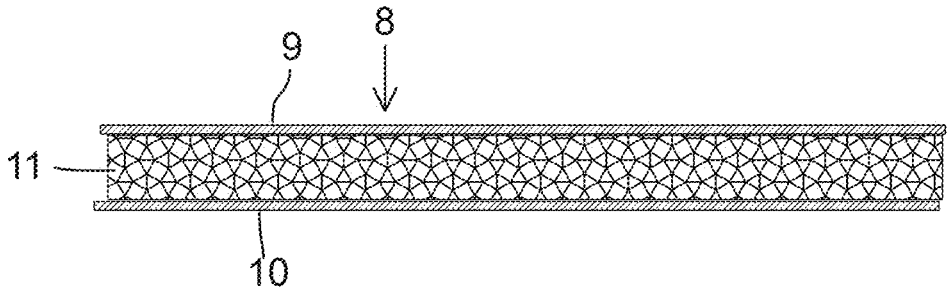
FIG. 4 is a cross-section of the counterweight screen according to second embodiment of the invention.
Figure 5:
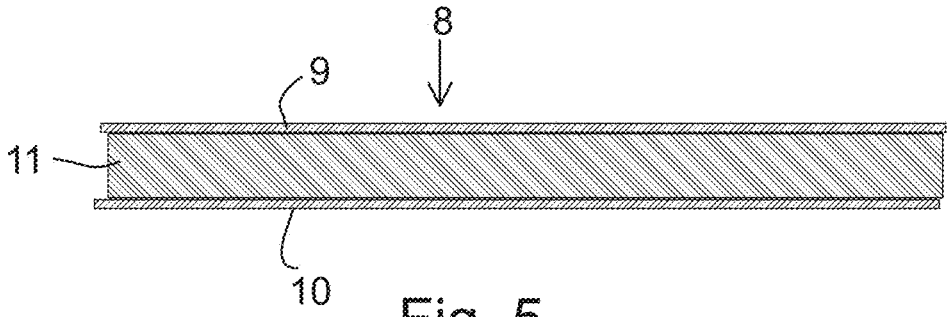
FIG. 5 is a cross-section of the counterweight screen according to third embodiment of the invention.

FIGS. 3 to 5 illustrate the sandwich-structured composite panel of the counterweight screen 8. The sandwich-structured composite panel comprises a first face skin 9, a second face skin 10, and a core 11 arranged between the first face skin 9 and the second face skin, 10 the first and second face skins 9, 10 being attached to the core 11. The first face skin 9 may be sheet metal and/or the second face skin 10 may be sheet metal. For example, the first face skin 9 may be steel sheet metal and/or the second face skin 10 may be steel sheet metal. In another example the first face skin 9 may be aluminum sheet metal and/or the second face skin 10 may be aluminum sheet metal. Alternatively, the first face skin 9 may be a polymer sheet and/or the second face skin 10 may be a polymer sheet. For example, the first face skin 9 may be a non-metallic fibre reinforced polymer matrix sheet and/or the second face skin 10 may be a non-metallic fibre reinforced polymer matrix sheet. Non-metallic fibre may be e.g. glass, carbon or aramid fibre. Fibre reinforcement may be a mat, weave, short fiber or continuous fiber unidirectional type of reinforcement.

FIG. 3 shows a cross-section of the counterweight screen 8 wherein the core 11 between the first face skin 9 and the second face skin 10 is a honeycomb structure. The honeycomb structure of the core 11 may be made of metal or polymer.

FIG. 4 shows a cross-section of the counterweight screen 8 wherein the core 11 between the first face skin 9 and the second face skin 10 is a micro lattice structure. The micro lattice structure of the core 11 may be made of metal or polymer.

FIG. 5 shows a cross-section of the counterweight screen 8 wherein the core 11 between the first face skin 9 and the second face skin 10 is a solid sheet made of polymer. In an embodiment the core 11 may be a sheet of polymer foam or polyurethane foam.

Figure 6:
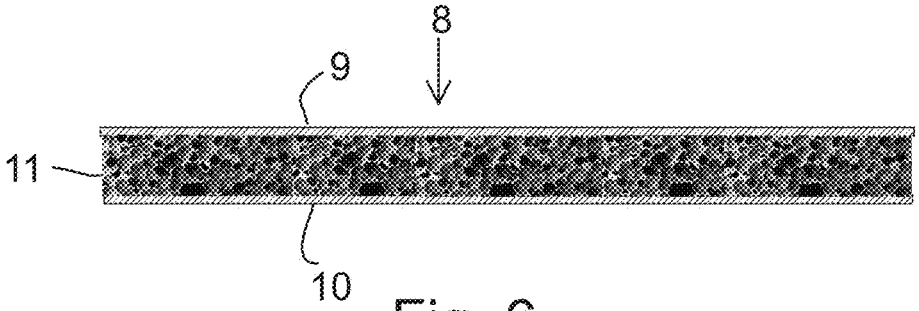
FIG. 6 is a cross-section of the counterweight screen according to fourth embodiment of the invention.

FIG. 6 shows a cross-section of the counterweight screen 8 wherein the core 11 between the first face skin 9 and the second face skin 10 is a metallic foam structure. The metallic foam structure of the core 11 may be made of aluminum.

Although the invention has been the described in conjunction with a certain type of elevator system, it should be understood that the invention is not limited to any certain type of elevator system. While the present inventions have been described in connection with a number of exemplary embodiments, and implementations, the present inventions are not so limited, but rather cover various modifications, and equivalent arrangements, which fall within the purview of prospective claims.

The invention claimed is:

1. An elevator system, comprising:

a shaft having a pit;

a car guided by a pair of first guide rails to be vertically movable in the shaft;

a counterweight connected to the car by a suspension rope, the counterweight being guided by a pair of second guide rails to be vertically movable in the shaft; and a counterweight screen in a space between the counterweight and the car, the counterweight screen being a sandwich-structured composite planar panel attached to the pair of second guide rails at the pit, wherein a height of the counterweight screen is greater than or equal to that of the counterweight.

2. The elevator system according to claim 1, wherein the counterweight screen comprises:

a first face skin;

a second face skin; and a core arranged between the first face skin and the second face skin with the first face skin and the second face skin attached to the core.

3. The elevator system according to claim 2, wherein at least one of the first face skin or the second face skin is sheet metal.

4. The elevator system according to claim 3, wherein at least one of the first face skin or the second face skin is steel sheet metal.

5. The elevator system according to claim 3, wherein at least one of the first face skin or the second face skin is aluminum sheet metal.

6. The elevator system according to claim 2, wherein at least one of the first face skin or the second face skin is a polymer sheet.

7. The elevator system according to claim 6, wherein at least one of the first face skin or the second face skin is a non-metallic fibre reinforced polymer matrix sheet.

8. The elevator system according to claim 2, wherein the core is a honeycomb structure.

9. The elevator system according to claim 8, wherein the honeycomb structure of the core is made of metal.

10. The elevator system according to claim 8, wherein the honeycomb structure of the core is made of polymer.

11. The elevator system according to claim 2, wherein the core is a micro lattice structure.

12. The elevator system according to claim 11, wherein the micro lattice structure of the core is made of metal.

13. The elevator system according to claim 11, wherein the micro lattice structure of the core is made of polymer.

14. The elevator system according to claim 2, wherein the core is a solid or foam sheet of polymer or polyurethane.

15. The elevator system according to claim 2, wherein the core is a metallic foam structure.

16. The elevator system according to claim 15, wherein the metallic foam structure of the core is made of aluminum.

17. The elevator system according to claim 1, wherein the counterweight screen is configured to withstand a force of 300 N over an area of 5 $cm^2$ without deflecting into a path of the counterweight.

18. The elevator system according to claim 1, wherein the counterweight screen has a thickness less than 6 mm.

19. A counterweight screen in a space between a counterweight and a car and attached to a pair of guide rails at a pit, the counterweight screen, comprising:

a first face skin;

a second face skin; and a core between the first face skin and the second face skin with the first face skin and second face skin attached to the core to form a sandwich-structured composite planar panel, wherein a height of the counterweight screen is greater than or equal to that of the counterweight.

* * * * *